US010233670B2

(12) United States Patent
Shintani et al.

(10) Patent No.: US 10,233,670 B2
(45) Date of Patent: Mar. 19, 2019

(54) INSTALLING METHOD OF DETECTING DEVICE THAT DETECTS STATE OF THUMBTUIRN, AND DETECTING DEVICE INSTALLABLE THEREBY

(71) Applicant: SHARP KABUSHIKI KAISHA, Sakai, Osaka (JP)

(72) Inventors: Jun Shintani, Sakai (JP); Atsushi Nagano, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 30 days.

(21) Appl. No.: 15/576,633

(22) PCT Filed: Jul. 7, 2016

(86) PCT No.: PCT/JP2016/070189
§ 371 (c)(1),
(2) Date: Nov. 22, 2017

(87) PCT Pub. No.: WO2017/014061
PCT Pub. Date: Jan. 26, 2017

(65) Prior Publication Data

US 2018/0142500 A1 May 24, 2018

(30) Foreign Application Priority Data

Jul. 21, 2015 (JP) ..... 2015-144210

(51) Int. Cl.
*E05B 41/00* (2006.01)
*E05B 17/22* (2006.01)
(Continued)

(52) U.S. Cl.
CPC ..... *E05B 41/00* (2013.01); *E05B 17/10* (2013.01); *E05B 17/22* (2013.01); *E05B 39/00* (2013.01); *E05B 2047/0094* (2013.01)

(58) Field of Classification Search
CPC ..... E05B 41/00; E05B 17/22; E05B 39/00
See application file for complete search history.

(56) References Cited

U.S. PATENT DOCUMENTS

2005/0115816 A1* 6/2005 Gelfond ..... G06F 3/0362 200/339
2006/0087412 A1* 4/2006 Umeo ..... B60R 25/1004 340/426.24
(Continued)

FOREIGN PATENT DOCUMENTS

JP 55-132833 U 9/1980
JP 2002-121940 A 4/2002
(Continued)

OTHER PUBLICATIONS

Written Opinion of the International Searching Authority, issued in PCT/JP2016/070189, PCT/ISA/237, dated Sep. 27, 2016.

*Primary Examiner* — Thomas D Alunkal
(74) *Attorney, Agent, or Firm* — Birch, Stewart, Kolasch & Birch, LLP

(57) ABSTRACT

A lock detecting device (10) which is capable of detecting a state of a thumbturn (1) and transmitting a detection result and is very versatile and device costs of which are small is provided. A sensor portion that detects whether the state of the thumbturn (1) is in a first state or in a second state orthogonal to the first state and a wireless communication portion that transmits a signal corresponding to a detection result of the sensor portion by wireless communication are included.

8 Claims, 7 Drawing Sheets

(51) Int. Cl.

| | |
|---|---|
| *E05B 39/00* | (2006.01) |
| *E05B 17/10* | (2006.01) |
| *E05B 47/00* | (2006.01) |

(56) References Cited

U.S. PATENT DOCUMENTS

| | | | | |
|---|---|---|---|---|
| 2006/0153733 | A1* | 7/2006 | Sassoon | A61L 2/18 422/28 |
| 2010/0102050 | A1* | 4/2010 | Fliess | B67D 1/0888 219/509 |
| 2012/0127317 | A1* | 5/2012 | Yantek | G01V 8/14 348/156 |
| 2014/0246573 | A1* | 9/2014 | Takeda | H04N 9/3129 250/235 |

FOREIGN PATENT DOCUMENTS

| | | | |
|---|---|---|---|
| JP | 2006-63613 | A | 3/2006 |
| JP | 5307449 | B2 | 10/2013 |

* cited by examiner

10:LOCK DETECTING DEVICE
11:SENSOR PORTION
20:FIRST HOUSING
21:FIRST BOARD
22:SECOND BOARD
23:LED
24:THREAD
30:SECOND HOUSING
31:TRANSMITTING FILTER
32:LIGHT TRANSMITTING PORTION
33:MARKER
40:THIRD HOUSING
41:THREAD GROOVE

10:LOCK DETECTING DEVICE
11:SENSOR PORTION
20:FIRST HOUSING
21:FIRST BOARD
22:SECOND BOARD
23:LED
24:THREAD
25:VISIBLE LIGHT EMITTING PORTION
30:SECOND HOUSING
31:TRANSMITTING FILTER
32:LIGHT TRANSMITTING PORTION
33:MARKER
40:THIRD HOUSING
41:THREAD GROOVE

INSTALLING METHOD OF DETECTING DEVICE THAT DETECTS STATE OF THUMBTUIRN, AND DETECTING DEVICE INSTALLABLE THEREBY

TECHNICAL FIELD

The present invention relates to a detecting device that detects a state of a thumbturn provided in an entrance door, various valves including a main tap of the gas or a branch faucet, a power switch of various types of equipment, a lock mechanism of a cabinet, a locker, or the like, etc.

BACKGROUND ART

Conventionally, a door open/close sensor that detects an opened/closed state of an entrance door by detecting a change in magnetic flux density according to opening/closing of the entrance door with use of a magnetic sensor has spread.

Moreover, in PTL 1, an electric lock device that includes a thumbturn cover engaged with a thumbturn of an entrance door, a motor that turns the thumbturn cover to thereby turn the thumbturn for locking/unlocking, and an angle detecting means that detects an angle of the thumbturn.

CITATION LIST

Patent Literature

PTL 1: Japanese Patent Publication No. 5307449 (published on Dec. 3, 2009)

SUMMARY OF INVENTION

Technical Problem

There is a case, for example, of being anxious about whether or not to lock an entrance door when being out or a case of forgetting to lock an entrance door even when being at home, so that it is desired that not only an opened/closed state of an entrance door but also a locked state of a thumbturn is able to be checked from any place, in terms of prevention of crimes.

However, with the above-described door open/close sensor that detects an opened/closed state of an entrance door by a magnetic sensor, it is possible to detect the opened/closed state of the door, but it is difficult to detect a locked state of a thumbturn (whether or not to be locked).

Moreover, a technique of PTL 1 above provides a configuration in which the thumbturn cover is engaged with the thumbturn, so that there are some cases where it is difficult to attach the electric lock device depending on (i) a shape, a size, or a material of the thumbturn, or (ii) a configuration of a periphery of the thumbturn in the entrance door (for example, a shape or a material of the entrance door, a position or a shape of a doorknob of the entrance door, or the like).

Moreover, in the technique of PTL 1, it is necessary to include not only the angle detecting means but also the motor or the like by which the thumbturn is turned for locking/unlocking, so that there is a problem that a device configuration is complicated.

Furthermore, in the technique of PTL 1, when engagement of the thumbturn cover with the thumbturn and operation setting of a turning system for locking/unlocking are not performed accurately, malfunctioning is caused in an opening/closing operation of the thumbturn, so that a user is not always able to easily install the electric lock device.

The invention has been made in view of the aforementioned problems, and an object thereof is to provide a detecting device which is capable of detecting a state of a thumbturn and transmitting a detection result and is very versatile and device costs of which are small.

Solution to Problem

A detecting device according to an aspect of the invention is arranged near a thumbturn and detects a state of the thumbturn, and includes: a sensor portion that detects whether the state of the thumbturn is a first state or a second state orthogonal to the first state; and a wireless communication portion that transmits a signal corresponding to a detection result of the sensor portion by wireless communication.

Advantageous Effects of Invention

According to the aforementioned configuration, it is possible to easily check a state of a thumbturn from any place apart from the thumbturn. Moreover, it is not necessary to include a motor by which a thumbturn is turned for locking/unlocking as the above-described conventional technique, and it is possible to detect a state of the thumbturn only by arranging the detecting device near the thumbturn, so that it is possible to realize a detecting device which is very versatile and device costs of which are small.

DESCRIPTION OF EMBODIMENTS

Embodiment 1

An embodiment of the invention will be described.

Figure 1:
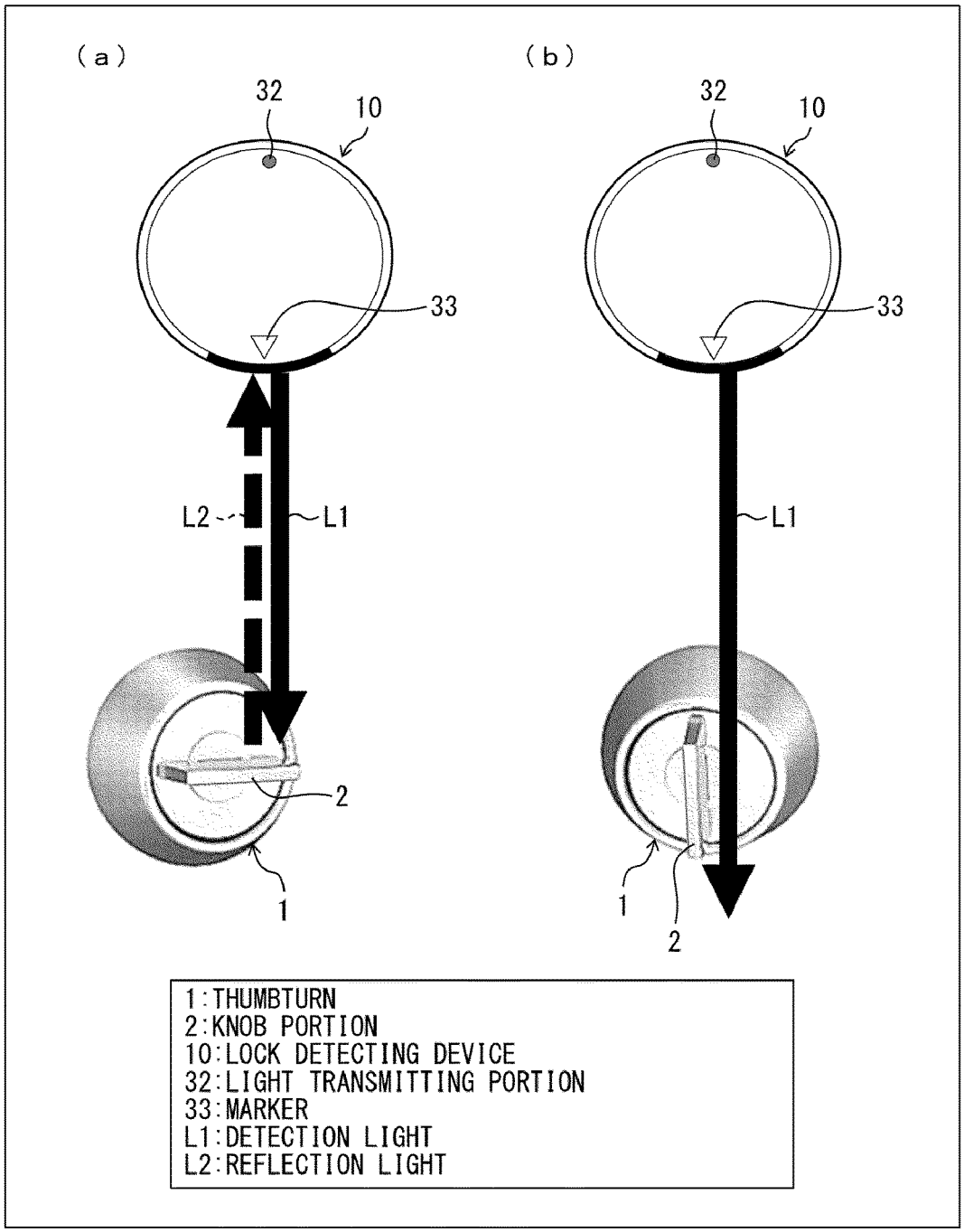
FIG. 1 is an explanatory drawing illustrating an installing method of a detecting device according to Embodiment 1 of the invention, in which (a) illustrates a case where a thumbturn is in a first state (one of a locked state and an unlocked state) and (b) illustrates a case where the thumbturn is in a second state (the other of the locked state and the unlocked state).

FIG. 1 is an explanatory drawing illustrating an installing method of a lock detecting device (detecting device) 10 according to the present embodiment, in which (a) illustrates a case where a thumbturn is in a first state (one of a locked state and an unlocked state) and (b) illustrates a case where the thumbturn is in a second state (the other of the locked state and the unlocked state).

As illustrated in (a) and (b) of FIG. 1, a thumbturn 1 includes a knob portion 2 to be gripped by a user in a case of performing a locking operation or an unlocking operation of the thumbturn 1. The knob portion 2 is formed by a plate-like member which is arranged so as to protrude in a direction orthogonal to a surface of a door, and is provided so as to be rotatable with respect to a main body of the thumbturn 1. The user grips the knob portion 2 and rotates the knob portion 2 by about 90° to thereby switch a state of the thumbturn 1 between the first state and the second state.

Moreover, as illustrated in (a) and (b) of FIG. 1, the lock detecting device 10 is arranged near the thumbturn 1 in a direction substantially orthogonal to a plate surface of the knob portion 2 in a case where the thumbturn 1 is in the first state and in a direction substantially parallel to the plate surface of the knob portion 2 in a case where the thumbturn 1 is in the second state. Note that, a distance between the lock detecting device 10 and the thumbturn 1 is not particularly limited as long as being within a range in which the locked state of the thumbturn 1 is able to be detected appropriately, and may be appropriately set in accordance with emission intensity of detection light L1 described below or light reception accuracy of reflection light L2 described below, but is generally set to be within a range from several centimeters to several tens of centimeters.

The lock detecting device 10 emits the detection light L1 so that, in the case where the thumbturn 1 is in the first state, the detection light L1 is incident on the plate surface of the knob portion 2 (refer to (a) of FIG. 1) and, in the case where the thumbturn 1 is in the second state, the detection light L1 is not incident on the plate surface of the knob portion 2 and passes near the knob portion 2 (refer to (b) of FIG. 1). The lock detecting device 10 detects whether the thumbturn 1 is in the first state or in the second state, on the basis of whether or not the reflection light L2 of the detection light L1 has been received from the knob portion 2.

Note that, an arrangement position of the lock detecting device 10 is not particularly limited as long as being a position at which the first state and the second state are able to be detected appropriately, and, for example, may be above or below the thumbturn 1 on the door, or may be on a left side or a right side of the thumbturn 1 in a horizontal direction. Moreover, without limitation to a configuration in which the lock detecting device 10 is attached to the door, the lock detecting device 10 may be arranged, for example, on a frame member, wall, or the like around the door.

Moreover, an attaching method of the lock detecting device 10 to an installed surface (door) is not particularly limited, and the lock detecting device 10 may be bonded by an adhesive, a double-sided tape, or the like, attached by a magnet, or attached by screwing or the like, for example.

Figure 2:
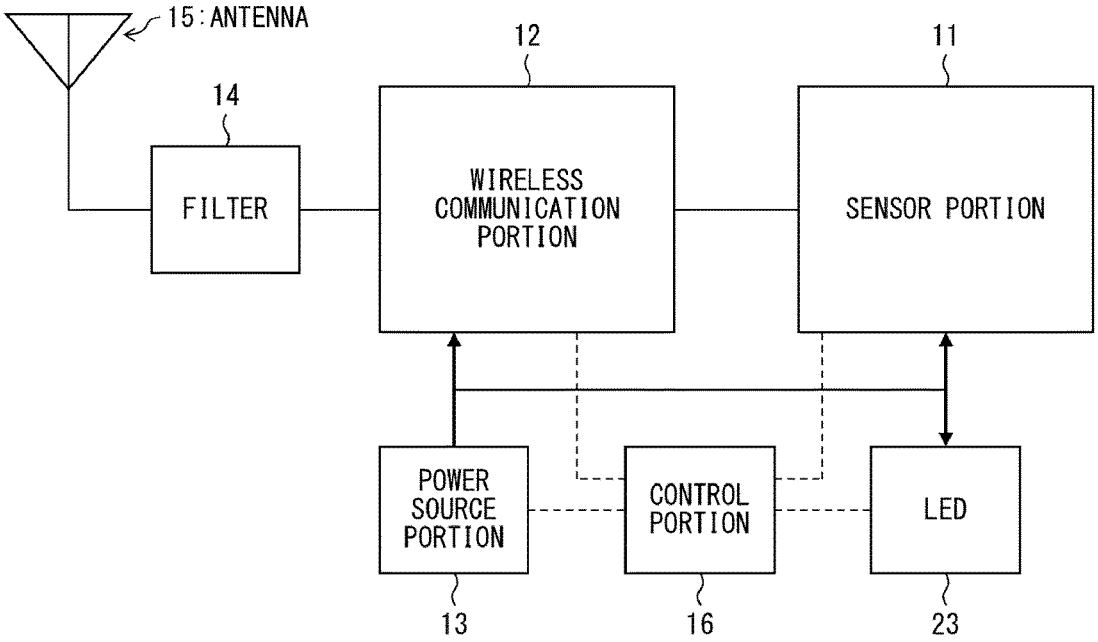
FIG. 2 is a block diagram illustrating a function configuration of the detecting device illustrated in FIG. 1.

FIG. 2 is a block diagram illustrating a function configuration of the lock detecting device 10. As illustrated in FIG. 2, the lock detecting device 10 includes a sensor portion 11, a wireless communication portion 12, a power source portion 13, a filter 14, an antenna 15, an LED 23, and a control portion 16.

The sensor portion 11 is a detecting means that detects whether the thumbturn 1 is in the first state or in the second state. In the present embodiment, the sensor portion 11 includes a detection light emitting portion and a reflection light receiving portion (neither of which is illustrated).

The detection light emitting portion emits detection light L1 so as to be incident on the plate surface of the knob portion 2 in the case where the thumbturn 1 is in the first state and so as to pass near the knob portion 2 without being incident on the plate surface of the knob portion 2 in the case where the thumbturn 1 is in the second state.

The reflection light receiving portion receives the reflection light L2 which is reflected by the plate surface of the knob portion 2 in the case where the thumbturn 1 is in the first state. Thereby, whether the thumbturn 1 is in the first state or in the second state is determined on the basis of whether or not the reflection light L2 has been received.

Note that, though near-infrared light (infrared ray) is used as the detection light L1 in the present embodiment, there is no limitation thereto. Moreover, for example, a distance detection sensor or a position detection sensor (a ranging sensor or a proximity sensor) each of which has been conventionally known may be used as the sensor portion 11.

The wireless communication portion 12 transmits a signal corresponding to a detection result of the sensor portion 11 to a predetermined transmission destination (for example, communication equipment with which pairing is established in advance) by wireless communication. Note that, the wireless communication portion 12 includes an RF (radio frequency) circuit (not illustrated) that performs processing of modulating a signal and transmitting the resultant with a predetermined frequency and processing of receiving and demodulating a signal of the predetermined frequency. The predetermined frequency is not particularly limited, and may be a 2.4 GHz band or may be a 920 MHz band, for example.

The wireless communication portion 12 may be configured to be connected to a server (cloud) on a communication network, communication equipment of a user, or the like via a gateway by using a communication scheme, for example, such as Bluetooth (registered trademark), ZigBee (registered trademark), Z-Wave (registered trademark), or WiFi (registered trademark). Moreover, the locked state of the thumbturn 1 may be uploaded to the server (cloud) on the communication network so that a user is able to check the locked state of the thumbturn 1 by accessing the server from communication equipment such as a PC, a smartphone, or a portable terminal. Thereby, it is possible to check the locked state of the thumbturn 1 from any indoor or outdoor place.

The power source portion 13 supplies, to the respective portions of the lock detecting device 10, power with which the respective portions are driven. A power supply source for the power source portion 13 is not particularly limited, and, for example, may be a battery equipped in or mounted on the lock detecting device 10, or power may be supplied from an external power source such as a commercial power source.

The filter 14 passes an electric signal of a specific frequency bandwidth which is adapted to a communication frequency of the wireless communication portion 12, and, on the other hand, intercepts an electric signal of a frequency bandwidth which is different from the specific frequency bandwidth.

The antenna 15 transmits or receives an electric signal as a radio wave. A configuration of the antenna 15 is not particularly limited, and is required only to be a configuration which enables transmission and reception of a radio wave of a predetermined frequency bandwidth.

The LED 23 reports a state (for example, whether or not there is communication equipment with which pairing is established) of the lock detecting device 10 by changing a light emitting state.

The control portion 16 controls an operation of each portion of the lock detecting device 10, and includes a CPU (Central Processing Unit) that executes various programs (for example, a program for controlling operations of the sensor portion 11, the wireless communication portion 12, and the power source portion 13, or the like), a ROM (Read Only Memory) that records therein each of the aforementioned programs, various parameters and data which are necessary for execution of the aforementioned programs, pairing information with equipment of a communication destination, and the like so as to be readable by the CPU, a RAM (Random Access Memory) into which the aforementioned programs are loaded, and the like. When the CPU reads the aforementioned program from the ROM and executes it, the operation of each portion of the lock detecting device 10 is controlled.

Note that, a part or all of the CPU, the ROM, and the RAM, which are included in the control portion 16, and the RF circuits provided in the wireless communication portion 12 may be integrated in a common chip. A configuration of the control portion 16 is not limited to one that is realized by a software with use of the CPU, and may be one that is realized by a logic circuit (hardware) formed in an integrated circuit (IC chip) or the like.

Figure 3:
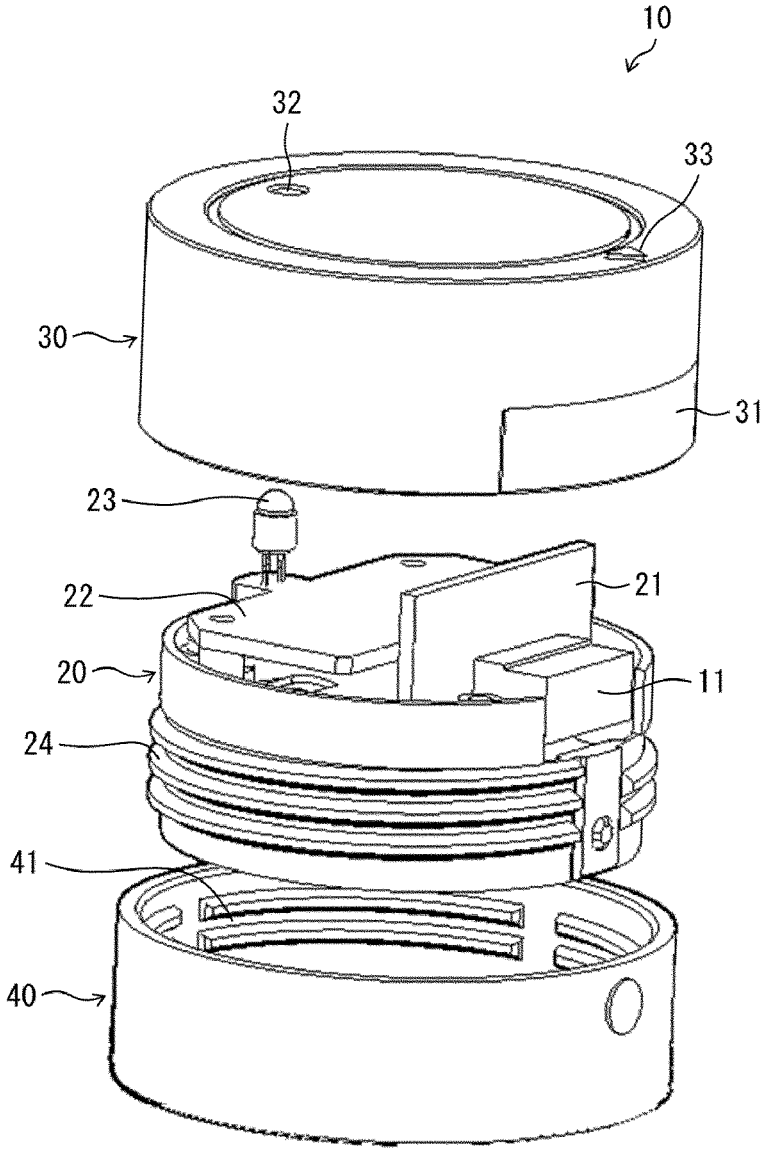
FIG. 3 is an exploded perspective view of the detecting device illustrated in FIG. 1.

FIG. 3 is an exploded perspective view of the lock detecting device 10. As illustrated in FIG. 3, the lock detecting device 10 includes a first housing 20, a second housing 30, and a third housing 40.

The first housing 20 is formed into a substantially cylindrical shape, and holds a first board 21 on which the sensor portion 11 is mounted, and a second board 22 on which the wireless communication portion 12, the power source portion 13, the filter 14, the antenna 15, and the control portion 16 are mounted.

Note that, the sensor portion 11 includes the detection light emitting portion that emits the detection light L1 and the reflection light receiving portion that receives the reflection light L2 (neither of which is illustrated), and is arranged so as to emit the detection light L1 toward an outer side of the first housing 20, formed in the substantially cylindrical shape, in a radius direction and to receive the reflection light L2 which is incident from the outer side of the first housing 20 in the radius direction.

On the second board 22, the LED 23 which is arranged so as to emit light toward an axis direction of the first housing 20 formed in the substantially cylindrical shape is mounted. The LED 23 changes the light emitting state in response to an instruction of the control portion 16 to thereby report the state (for example, whether or not there is communication equipment with which pairing is established) of the lock detecting device 10. For example, the control portion 16 switches the light emitting state of the LED 23 to any of a lighting state, a non-lighting state, and a flashing state in accordance with the state of the lock detecting device 10. Alternatively, by using an LED which is capable of emitting emission light of a plurality of colors as the LED 23, the control portion 16 may switch a color of the emission light in accordance with the state of the lock detecting device 10.

Moreover, though a configuration in which the sensor portion 11 is mounted on the first board 21 and the wireless communication portion 12, the power source portion 13, the filter 14, the antenna 15 and the control portion 16 are mounted on the second board 22 is described in the present embodiment, there is no limitation thereto. For example, the sensor portion 11, the wireless communication portion 12, the power source portion 13, the filter 14, the antenna 15, and the control portion 16 may be mounted on a common board, or may be provided in a dispersed manner on a larger number of boards.

The second housing 30 has a substantially cylindrical shape having one end side in an axis direction closed, and is attached to the first housing 20 so as to cover one surface of the first housing 20 in the axis direction. Note that, an attaching method of the second housing 30 to the first housing 20 is not particularly limited. For example, the attachment may be performed by engaging a protrusion provided in one of the first housing 20 and the second housing 30 with a groove provided in the other, by an adhesive, welding, or the like, or by screwing from a rear surface side (side of the third housing 40) of the first housing 20 or the like. In addition, after attaching the second housing 30 to the first housing 20, the housings may be fixed to each other by a lock mechanism.

In the second housing 30, a transmitting filter 31 is provided at a position facing the sensor portion 11 on an outer side of the cylindrical shape in a radius direction. The transmitting filter 31 transmits light (in the present embodiment, near-infrared light) in a wavelength region adapted to the detection light L1 and the reflection light L2, and, on the other hand, intercepts light in a different wavelength region.

Moreover, a light transmitting portion 32 is provided at a position facing the LED 23, which is on a surface closing the one end side of the second housing 30 in the axis direction. The light transmitting portion 32 transmits the emission light of the LED 23 to perform emission to an outside of the second housing 30. Note that, the light transmitting portion 32 may have a lens function of performing emission by scattering the light incident from the LED 23.

Moreover, a marker 33 indicating an emission direction of the detection light L1 is formed on a part of an outer surface of the surface closing the one end side of the second housing 30 in the axis direction. As the marker 33, an arrow, a triangle, or the like may be used, for example.

The third housing 40 has a substantially cylindrical shape having one end side in an axis direction closed, and is attached to the first housing 20 so as to cover the other surface (surface opposite to the surface to which the second housing 30 is attached) of the first housing 20 in the axis direction.

Specifically, a thread 24 protruding toward an outer side in a diameter direction is formed on an outer peripheral surface of the first housing 20, and a thread groove 41 corresponding to the thread 24 is formed on an inner peripheral surface of the cylindrical shape of the third housing 40. Thereby, when the thread 24 is screwed in the thread groove 41 while being rotated, the first housing 20 is attached to the third housing 40. Note that, a locking mechanism by which, when the thread 24 is screwed in the thread groove 41 to a predetermined position, the first housing 20 and the third housing 40 are locked and movement of the both housings is restricted may be provided. Further, a depth of screwing of the thread 24 with respect to the thread groove 41 may be freely set so that a relative height of the first housing 20 with respect to the third housing 40 (relative height of the lock detecting device 10 with respect to the installed surface (door)) is able to be freely set.

Note that, an attaching method of the third housing 40 to the first housing 20 is not limited to the above-described method. For example, the attachment may be performed by engaging a protrusion provided in one of the first housing 20 and the third housing 40 with a groove provided in the other, by an adhesive, welding, or the like, or by screwing or the like. In addition, after attaching the third housing 40 to the first housing 20, the housings may be fixed to each other by a lock mechanism.

Figure 4:
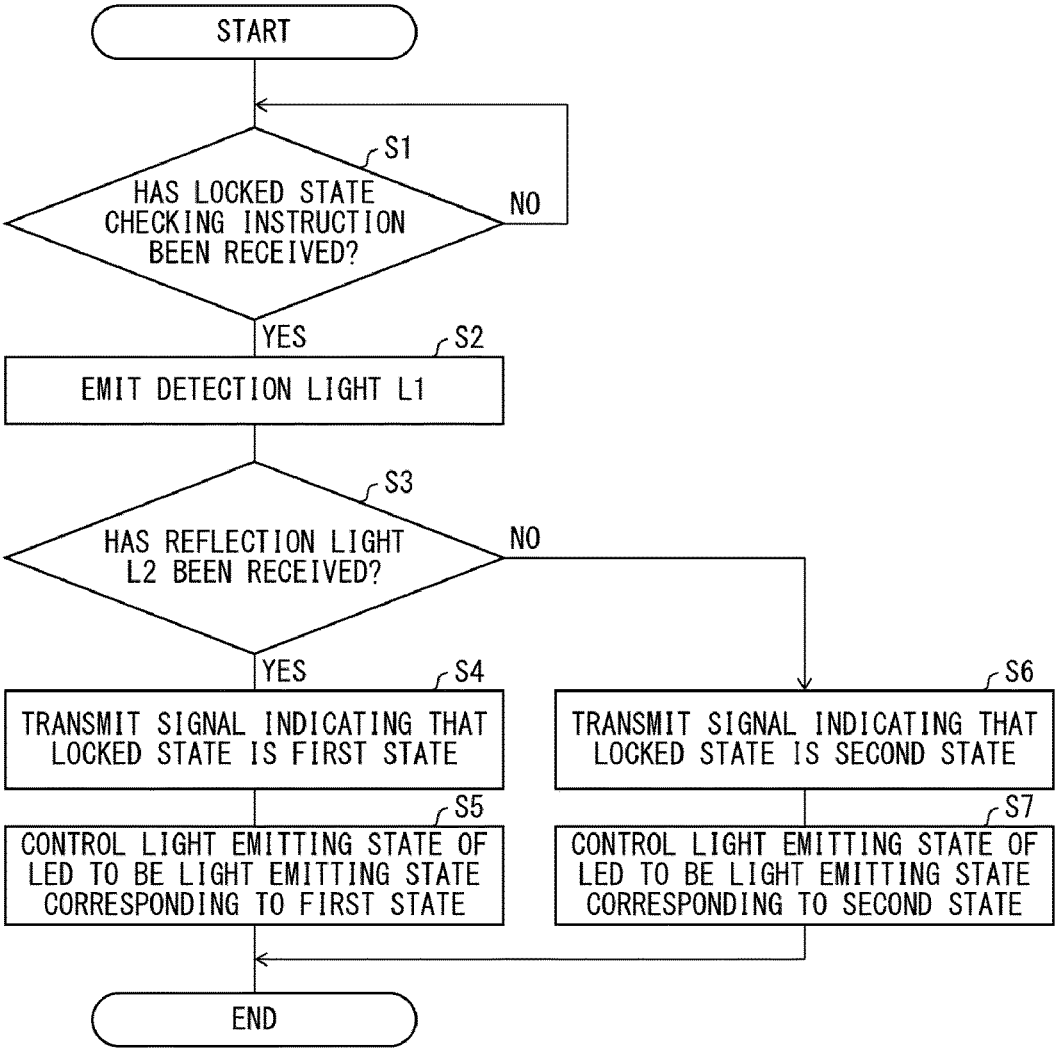
FIG. 4 is a flowchart illustrating a flow of processing in the detecting device illustrated in FIG. 1.

FIG. 4 is a flowchart illustrating a flow of processing in the lock detecting device 10.

The control portion 16 controls the operation of the wireless communication portion 12 and monitors reception of a locked state checking instruction from different communication equipment (for example, a portable terminal possessed by a user) (S1).

Then, in a case where the lock state checking instruction has been received, the control portion 16 controls the operation of the sensor portion 11 to emit the detection light L1 (S2), and determines whether or not the sensor portion 11 has received the reflection light L2 (S3).

In a case where, at S3, it is determined that the sensor portion 11 has received the reflection light L2, the control portion 16 controls the operation of the wireless communication portion 12 to transmits a signal indicating that the locked state of the thumbturn 1 is the first state to the different communication equipment (S4).

Note that, by setting that the first state (or the second state) is the locked state or the unlocked state in advance and storing the setting in a storage portion (not illustrated) included in the lock detecting device 10, a signal indicating that the state is the locked state or the unlocked state may be transmitted. Moreover, by storing information indicating that the first state (or the second state) is the locked state or the unlocked state in communication equipment which performs communication with the lock detecting device 10, the communication equipment may determine whether the state is the locked state or the unlocked state in accordance with a signal indicating that the state is the first state or the second state, which is received from the lock detecting device 10, and notify a user of a determination result.

Moreover, in the case where, at S3, it is determined that the sensor portion 11 has received the reflection light L2, the control portion 16 controls the light emitting state of the LED 23 to be a light emitting state indicating that the locked state of the thumbturn 1 is the first state (S5), and ends the processing.

On the other hand, in a case where, at S3, it is determined that the sensor portion 11 has not received the reflection light L2, the control portion 16 controls the operation of the wireless communication portion 12 to transmit a signal indicating that the locked state of the thumbturn 1 is the second state to the different communication equipment (S6).

Moreover, in the case where, at S3, it is determined that the sensor portion 11 has not received the reflection light L2, the control portion 16 controls the light emitting state of the LED 23 to be a light emitting state indicating that the locked state of the thumbturn 1 is the second state (S7), and ends the processing.

As above, the lock detecting device 10 according to the present embodiment includes the sensor portion 11 that detects whether the state of the knob portion 2 is the first state (one of the locked state and the unlocked state) or the second state (the other of the locked state and the unlocked state), and the wireless communication portion 12 that transmits a signal corresponding to a detection result of the sensor portion 11 to a predetermined transmission destination by wireless communication.

Thereby, it is possible to easily check the locked state of the thumbturn 1 from any place apart from a door. Moreover, since it is not necessary to include a motor by which the thumbturn 1 is turned for locking/unlocking or the like and it is possible to detect the locked state of the thumbturn 1 only by arranging the lock detecting device 10 near the thumbturn 1, it is possible to realize the lock detecting device 10 which is very versatile and device costs of which are small.

Note that, though description has been given in the present embodiment for the configuration in which an outer shape of the lock detecting device 10 is the substantially cylindrical shape, the shape of the lock detecting device 10 is not particularly limited, and, for example, may be a rectangular parallelepiped shape, a polygonal prism shape, a hemispherical shape, or the like.

Embodiment 2

Another embodiment of the invention will be described. Note that, for convenience of description, the same reference signs will be assigned to members having the same functions as those of the above-described embodiment, and description thereof will be omitted.

Figure 5:
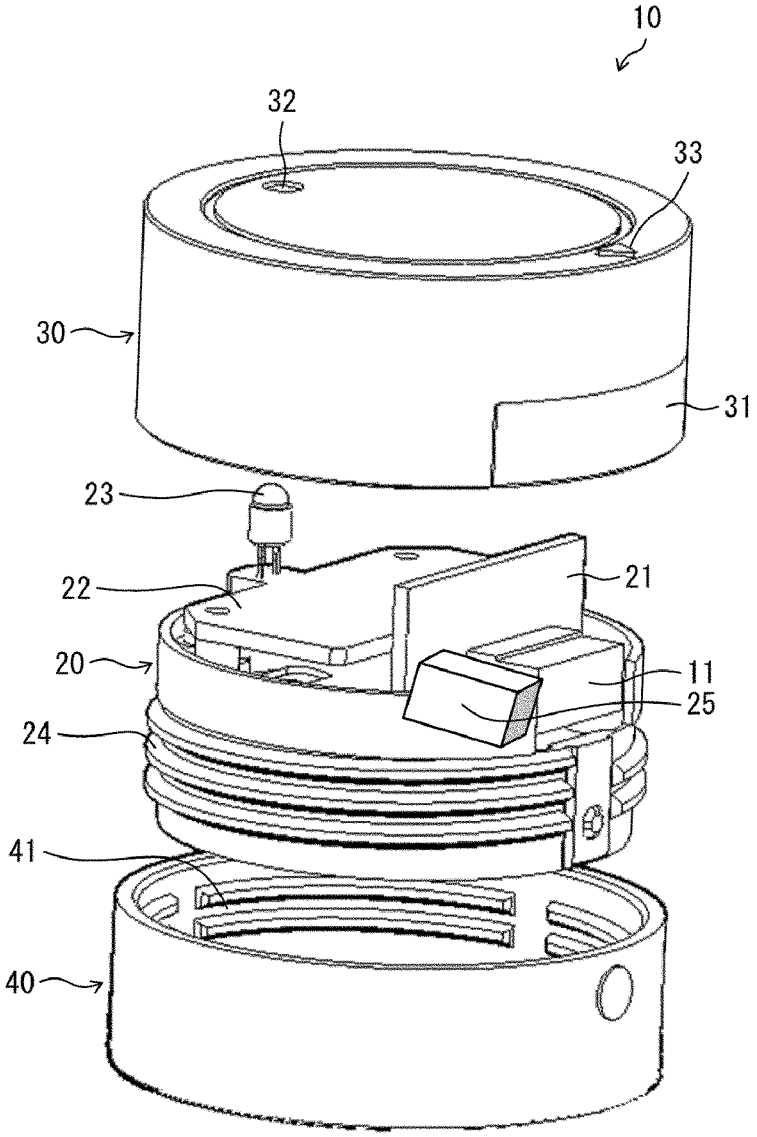
FIG. 5 is an exploded perspective view of a detecting device according to Embodiment 2 of the invention.

FIG. 5 is an exploded perspective view of the lock detecting device 10 according to the present embodiment. As illustrated in the figure, the lock detecting device 10 according to the present embodiment includes a visible light emitting portion 25 in addition to the configuration of Embodiment 1, which is illustrated in FIG. 3.

When installing the lock detecting device 10 on the installed surface, it is necessary to perform positioning so that the detection light L1 is incident on an appropriate position of the knob portion 2. That is, in a case where the positioning of the lock detecting device 10 is not able to be appropriately performed, there is a possibility that erroneous detection of the locked state is caused or a case in which detection of the locked state is not able to be performed is caused. However, the present embodiment provides the configuration in which the sensor portion 11 emits near-infrared light as the detection light L1, so that it is not possible to visually confirm the detection light L1.

Then, in the present embodiment, the visible light emitting portion 25 is provided, and an installation position (an attachment position with respect to the installed surface, an attachment angle, and an attachment height of the sensor portion 11 (detection light emitting portion)) of the lock detecting device 10 are adjusted on the basis of a visible ray emitted from the visible light emitting portion 25.

The visible light emitting portion 25 emits a visible ray (ray in a wavelength region which is visually recognizable with a human eye), and is mounted on the first board 21 and arranged on a side part of the sensor portion 11.

Note that, a configuration of the visible light emitting portion 25 is not particularly limited as long as being able to emit a visible ray, and, for example, a laser diode, an LED, or the like may be used therefor. In a case of using the laser diode, since it is possible to emit a visible ray having high luminance, a spot region of the visible ray is able to be distinctly displayed on the thumbturn 1 regardless of a material or a color of the thumbturn 1, thus making it possible to easily perform adjustment of the attachment position with respect to the installed surface, the attachment angle, and the attachment height.

Moreover, in order to shorten a diameter of a spot of the visible ray emitted from the visible light emitting portion 25, a lens may be arranged on an optical path of the visible ray emitted from the visible light emitting portion 25.

A color of the visible ray emitted from the visible light emitting portion 25 is not particularly limited, but it is preferable to be a color having high visibility (for example, red or the like).

In the present embodiment, the visible light emitting portion 25 is arranged so as to perform emission of a visible ray, which is substantially parallel to the detection light L1 emitted from the sensor portion 11. However, there is no limitation thereto, and, for example, the visible light emitting portion 25 may be arranged in a tilted manner with respect to an optical axis direction of the detection light L1 so as to emit the visible ray toward an incident position of the detection light L1 on the knob portion 2 of the thumbturn 1, with which detection accuracy of the state of the knob portion 2 by the sensor portion 11 becomes the maximum.

Moreover, an arrangement position of the visible light emitting portion 25 is not limited to the side part of the sensor portion 11 (with respect to the sensor portion 11, a position in a direction parallel to the installed surface and orthogonal to the emission direction of the detection light L1), and the arrangement may be performed on an upper part of the sensor portion 11 (with respect to the sensor portion 11, a position in a direction orthogonal to the installed surface), for example.

When the wireless communication portion 12 receives an installation adjusting instruction from different communication equipment (for example, a portable terminal possessed by a user or the like), the control portion 16 controls an operation of the visible light emitting portion 25 to emit the visible ray. Alternatively, by providing the lock detecting device 10 with an operation portion (for example, a button or the like) by which a user gives, to the visible light emitting portion 25, an emitting instruction of the visible ray, the control portion 16 may cause the visible light emitting portion 25 to emit the visible ray, when the emitting instruction of the visible ray is given via the operation portion.

Thereby, when attaching the lock detecting device 10 to the installed surface, a user is able to easily adjust the attachment position, the attachment angle, and the attachment height while referring to the visible ray.

That is, although near-infrared light which is not visually recognizable with a human eye is used as the detection light L1 in the present embodiment, by setting the attachment position, the attachment angle, and the attachment height of the lock detecting device 10 with respect to the installed surface so that the knob portion 2 of the thumbturn 1 which is set to be in the first state is arranged on the optical path of the visible ray, it is possible to easily and appropriately adjust the attachment position, the attachment angle, and the attachment height of the lock detecting device 10 with respect to the installed surface.

Note that, in the present embodiment, the attachment height (distance between the installed surface and the detection light emitting portion of the sensor portion 11) of the lock detecting device 10 is able to be easily adjusted by adjusting a screwing amount of the thread (emitting position adjustment mechanism) 24 formed in the first housing 20 in the thread groove (emitting position adjustment mechanism) 41 formed in the third housing 40. Alternatively, the attachment height of the lock detecting device 10 may be adjusted by inserting a spacer (emitting position adjustment mechanism) into a space between the third housing 40 and the installed surface. Moreover, by preparing a plurality of types of third housings (emitting position adjustment mechanisms) 40 whose heights in an axis direction are different, the third housing 40 among the plurality of types of third housings 40, with which the attachment height becomes optimum may be used. In addition, it may be configured so that a relative position of the first board 21 with respect to the first housing 20, a relative position of the sensor portion 11 with respect to the first board 21, or a position of the detection light emitting portion in the sensor portion 11 is able to be adjusted.

Thereby, it is possible to adjust a position of the sensor portion 11 (detection light emitting portion) in the lock detecting device 10 in accordance with shapes, sizes, and the like of the thumbturn 1 and the installed surface (a door, or a frame member, a wall, or the like around a door). Thus, it is possible to realize the lock detecting device 10 which is much more versatile.

Embodiment 3

Still another embodiment of the invention will be described. Note that, for convenience of description, the same reference signs will be assigned to members having the same functions as those of the above-described embodiments, and description thereof will be omitted.

Figure 6:
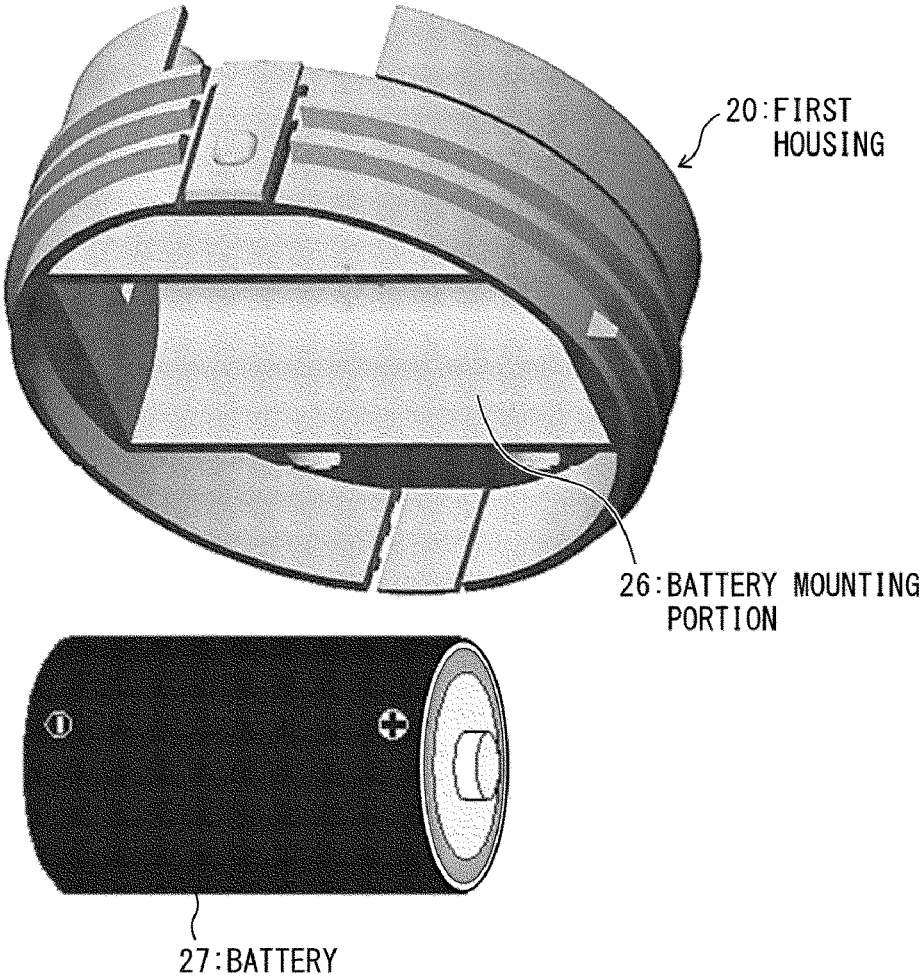
FIG. 6 is a perspective view illustrating a configuration of a first housing included in a detecting device according to Embodiment 3 of the invention.

FIG. 6 is a perspective view illustrating a configuration of a rear surface (surface on a side of the third housing 40) of the first housing 20 included in the lock detecting device 10 according to the present embodiment.

As illustrated in FIG. 6, in the present embodiment, a battery mounting portion 26 on which a battery 27 is detachably mounted is provided on a side of the rear surface of the first housing 20. The battery mounting portion 26 includes a storing portion that stores the battery 27 therein and electrode terminals each of which abuts on each of a positive electrode and a negative electrode of the battery 27 stored in the storing portion. Thereby, power on which each portion of the lock detecting device 10 operates is supplied to the power source portion 13 from the battery 27 via the both electrode terminals.

Note that, although description has been given in the present embodiment for a configuration in which the battery 27 is detachably mounted on the battery mounting portion 26, there is no limitation thereto, and the battery 27 may be equipped so as not to be easily detached. Moreover, the battery 27 may be a rechargeable battery.

As above, by providing a configuration in which the battery 27 is equipped in the lock detecting device 10 or the battery 27 is detachably mounted thereon, power source supply from an outside becomes unnecessary, so that it is possible to omit wiring used for power source supply from the outside. Accordingly, it is possible to simplify the configuration of the lock detecting device 10 and also improve a degree of freedom of an installation place of the lock detecting device 10.

Embodiment 4

Still another embodiment of the invention will be described. Note that, for convenience of description, the same reference signs will be assigned to members having the same functions as those of the above-described embodiments, and description thereof will be omitted.

Figure 7:
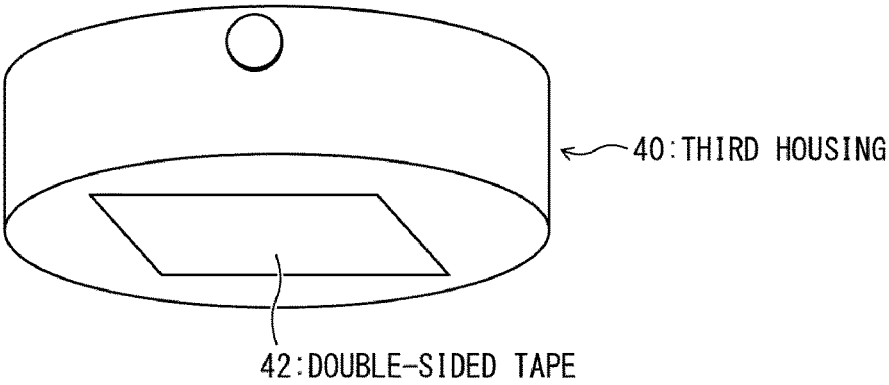
FIG. 7 is a perspective view illustrating a configuration of a third housing included in a detecting device according to Embodiment 4 of the invention.

FIG. 7 is a perspective view illustrating a configuration of a rear surface (surface on a side which is attached to the installed surface) of the third housing 40 included in the lock detecting device 10 according to the present embodiment.

As illustrated in FIG. 7, in the present embodiment, a double-sided tape 42 is stuck on the rear surface of the third housing 40, and the lock detecting device 10 is to be stuck on the installed surface (a door, or a frame member, a wall, or the like around the door) by using the double-sided tape 42. Note that, the double-sided tape 42 is required only to have a configuration by which the lock detecting device 10 is able to be stuck on the installed surface with sufficient sticking strength, and a size, a shape, a material, and the like of the double-sided tape 42 are not particularly limited.

Thereby, it is possible to easily attach the lock detecting device 10 to the installed surface (a door, or a frame member, a wall, or the like around the door). Moreover, it is possible to easily change the attachment position with respect to the installed surface as necessary.

Embodiment 5

Still another embodiment of the invention will be described. Note that, for convenience of description, the same reference signs will be assigned to members having the same functions as those of the above-described embodiments, and description thereof will be omitted.

In Embodiment 1, description has been given for a case where the control portion 16 performs detection processing of the locked state of the thumbturn 1 when the locked state checking instruction is received from different communication equipment.

On the other hand, a configuration in which the lock detecting device 10 performs detection processing of the locked state every predetermined time will be described in the present embodiment.

Figure 8:
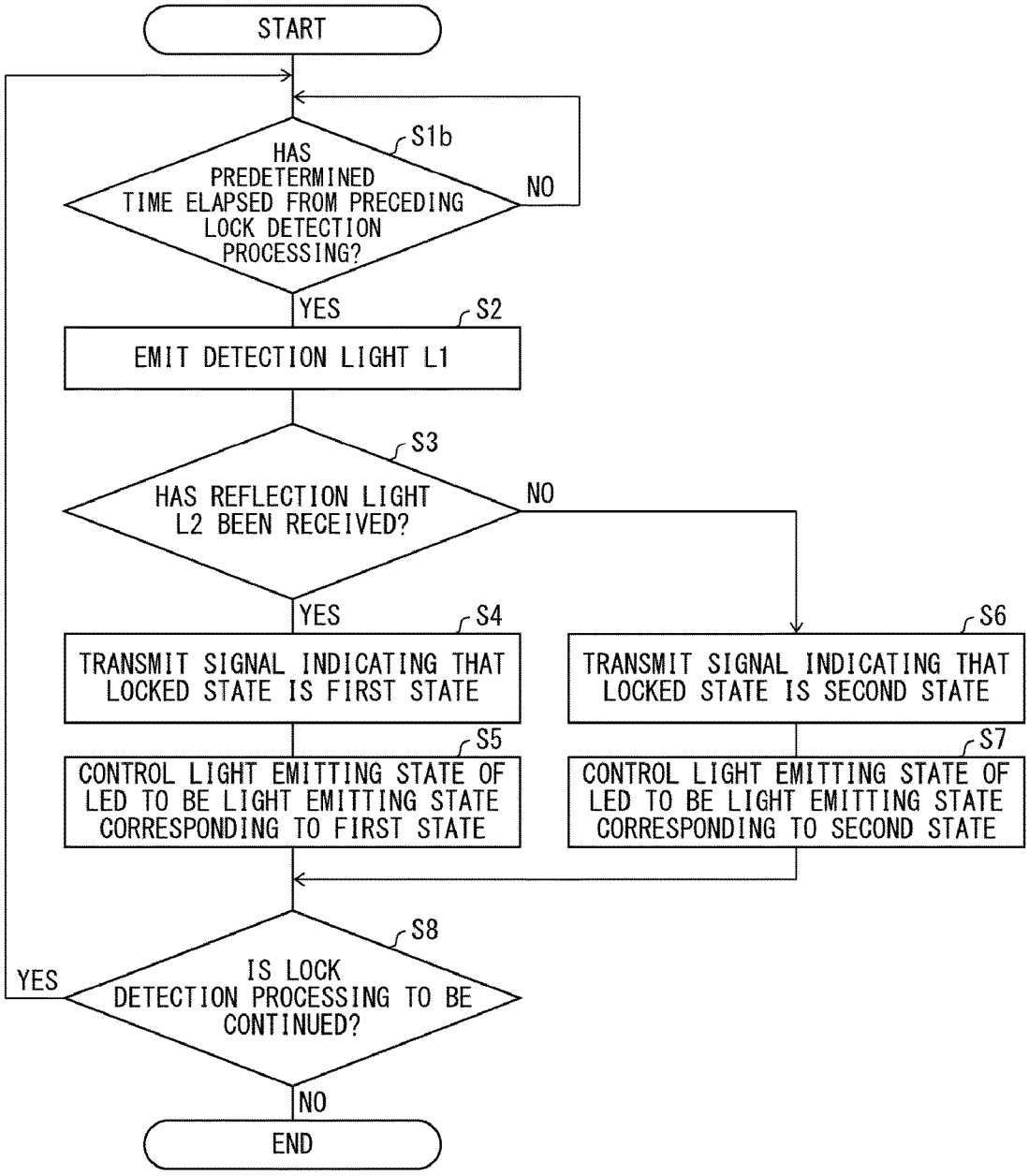
FIG. 8 is a flowchart illustrating a flow of processing in a detecting device according to Embodiment 5 of the invention.

FIG. 8 is a flowchart illustrating a flow of processing of the lock detecting device 10 in the present embodiment.

As illustrated in the figure, the control portion 16 determines whether or not the predetermined time has elapsed from preceding lock detection processing (S1*b*). The predetermined time is able to be freely set, for example, by a user. Note that, at a time of first lock detection processing, the processing of S1*b* is omitted and processing of S2 is performed.

In a case where, at S1*b*, it is determined that the predetermined time has not elapsed, the control portion 16 continuously performs the processing of S1*b*, and monitors elapse of the predetermined time.

On the other hand, in a case where, at S1*b*, it is determined that the predetermined time has elapsed, the control portion 16 performs processing similar to that of S2 to S7, which is illustrated in FIG. 4.

Thereafter, the control portion 16 determines whether or not to continue the lock detection processing (S8), and return to the processing of S1*b* in a case where determination is made that the lock detection processing is to be continued, and ends the processing in a case where determination is made that the lock detection processing is not to be continued. Note that, whether or not to continue the lock detection processing is determined by the control portion 16, for example, on the basis of a condition (a period, the number of times, a time zone, or the like of performing the lock detection processing) which is set by a user in advance.

Note that, in a case where each portion of the lock detecting device 10 is driven by power supplied from a lithium battery (CR123A) mounted on the lock detecting device 10 and used by the using method described in the present embodiment, a battery life equal to or more than about 1.5 years may be expected.

Embodiment 6

Still another embodiment of the invention will be described. Note that, for convenience of description, the same reference signs will be assigned to members having the same functions as those of the above-described embodiments, and description thereof will be omitted.

In each of the aforementioned embodiments, description has been given for the configuration in which the locked state of the thumbturn 1 provided on a door is detected by using the lock detecting device (detecting device) 10. However, a target to be detected by the lock detecting device 10 is not limited to the locked state of the thumbturn 1 provided on the door, and, in a case of a configuration in which a knob portion which is gripped by a user and subjected to a turning operation to thereby switch between a first state and a second state is included, the lock detecting device (detecting device) 10 may be applied to detection of a state of the knob portion.

That is, with a configuration in which a knob portion that is a knob portion turned with a predetermined turning axis as a center and has a shape protruding in a direction parallel to the turning axis and extending in a predetermined direction orthogonal to a direction of the turning axis when being viewed along the direction of the turning axis is included and a first state and a second state are switched when the knob portion is turned about the turning axis by a predetermined angle (for example, 90°), it is possible to detect whether the knob portion is in the first state or in the second state orthogonal to the first state by using the lock detecting device 10. Note that, in the present specification, a device that includes a knob portion having the aforementioned configuration is generically referred to as a thumbturn.

Examples of the device that includes the knob portion having the aforementioned configuration include various valves including a main tap of the gas or a branch faucet, a power switch of various types of equipment, a lock mechanism of a cabinet, a locker, or the like, etc. That is, by installing the lock detecting device (detecting device) 10 described in each of the aforementioned embodiments near the knob portion provided in each equipment described above (various valves, a power switch, a lock mechanism, etc.), it is possible to use the lock detecting device (detecting device) 10 as a detecting device that detects whether the knob portion is in the first state or in the second state orthogonal to the first state and transmits a detection result to a predetermined transmission destination.

CONCLUSION

A detecting device (lock detecting device) 10 according to an aspect 1 of the invention is a detecting device (lock detecting device 10) that is arranged near a thumbturn 1 and detects a state of the thumbturn 1, including: a sensor portion 11 that detects whether the state of the thumbturn 1 is a first state or a second state orthogonal to the first state; and a wireless communication portion 12 that transmits a signal corresponding to a detection result of the sensor portion 11 by wireless communication.

With the aforementioned configuration, the sensor portion 11 detects whether the state of the thumbturn 1 is the first state or the second state, and the wireless communication portion 12 transmits a signal corresponding to a detection result of the sensor portion 11 to a predetermined transmission destination by wireless communication. Thereby it is possible to easily check the state of the thumbturn 1 from any place apart from the thumbturn 1. Moreover, it is not necessary to include a motor by which the thumbturn is turned for locking/unlocking as the above-described conventional technique, and it is possible to detect the state of the thumbturn 1 only by arranging the detecting device (lock detecting device 10) near the thumbturn 1, so that it is possible to realize a detecting device (lock detecting device 10) which is very versatile and device costs of which are small.

The detecting device (lock detecting device 10) according to an aspect 2 of the invention has a configuration in which, in the aspect 1, the thumbturn 1 includes a knob portion 2 which is gripped and turned by a user to thereby switch between a locked state and an unlocked state, the sensor portion 11 includes a detection light emitting portion that emits detection light L1 and a reflection light receiving portion that receives reflection light L2 of the detection light L1 reflected by the knob portion 2, the detection light emitting portion is arranged so that, in a case where the knob portion 2 is in the first state, the reflection light L2 is incident on the reflection light receiving portion and, in a case where the knob portion 2 is in the second state, the reflection light L2 is not incident on the reflection light receiving portion, and the sensor portion 11 detects whether the thumbturn 1 is in the first state or in the second state, on the basis of whether or not the reflection light receiving portion has received the reflection light L2.

With the aforementioned configuration, only by arranging the detection light emitting portion so that, in the case where the knob portion 2 is in the first state, the reflection light L2 of the detection light L1 is incident on the reflection light receiving portion and, in the case where the knob portion 2 is in the second state, the reflection light L2 is not incident on the reflection light receiving portion, it is possible to easily detect the locked state of the thumbturn 1.

The detecting device (lock detecting device 10) according to an aspect 3 of the invention has a configuration in which, in the aspect 2, the detection light L1 is an infrared ray, and a visible light emitting portion 25 that emits a visible ray in a direction according to an emission direction of the detection light L1 is included. Note that, the aforementioned direction may be, for example, a direction parallel to the detection light L1, or may be a direction toward an incident position of the detection light L1 on the knob portion 2, with which detection accuracy of the state of the knob portion 2 by using the detection light L1 becomes the maximum.

With the aforementioned configuration, it is possible to position the detecting device (lock detecting device 10) by using the visible ray emitted from the visible light emitting portion 25.

The detecting device (lock detecting device 10) according to an aspect 4 of the invention has a configuration in which, in the aspect 2 or 3, an emitting position adjustment mechanism (thread 24, thread groove 41) with which a distance between an installed surface to which the detecting device (lock detecting device 10) is attached and the detection light emitting portion is adjusted is included.

With the aforementioned configuration, it is possible to adjust an installation height of the detection light emitting portion in accordance with a shape of the thumbturn 1 targeted for lock detection processing, a shape of the installed surface, or the like, so that it is possible to realize a detecting device (lock detecting device 10) which is very versatile and has high detection accuracy.

The detecting device (lock detecting device 10) according to an aspect 5 of the invention has a configuration in which, in any of the aspects 1 to 4, a battery 27 that supplies power on which the sensor portion 11 and the wireless communication portion 12 operate or a battery mounting portion 26 on which the battery 27 is mounted is included.

With the aforementioned configuration, it is possible to drive the sensor portion 11 and the wireless communication portion 12 by using the power supplied from the battery 27.

The invention is not limited to each of the embodiments described above and may be modified in various manners within the scope of the claims, and an embodiment achieved by appropriately combining technical means disclosed in different embodiments is also encompassed in the technical scope of the invention. Further, by combining the technical means disclosed in each of the embodiments, a new technical feature may be formed.

REFERENCE SIGNS LIST

1 thumbturn
2 knob portion
10 lock detecting device (detecting device)
11 sensor portion
12 wireless communication portion
13 power source portion
14 filter
15 antenna
16 control portion
20 first housing
21 first board
22 second board
23 LED
24 thread (emitting position adjustment mechanism)
25 visible light emitting portion
26 battery mounting portion
27 battery
30 second housing
31 transmitting filter
32 light transmitting portion
33 marker
40 third housing
41 thread groove (emitting position adjustment mechanism)
42 double-sided tape
L1 detection light
L2 reflection light

The invention claimed is:

1. A detecting device that is arranged near a thumbturn and detects a state of the thumbturn, the thumbturn including a knob portion which is gripped and turned by a user to thereby switch between a first state and a second state, comprising:

a sensor portion; and a wireless communication portion that transmits a signal corresponding to a detection result of the sensor portion by wireless communication; wherein the sensor portion includes a detection light emitting portion that emits detection light and a reflection light receiving portion that receives reflection light reflected by the knob portion from the detection light, the detection light emitting portion is arranged so that, in a case where the knob portion is in the first state, the reflection light is incident on the reflection light receiving portion and, in a case where the knob portion is in the second state, the reflection light is not incident on the reflection light receiving portion, the sensor portion detects whether the thumbturn is in the first state or in the second state, on the basis of whether or not the reflection light receiving portion has received the reflection light, the detection light is an infrared ray, and the detecting device further includes a visible light emitting portion that emits a visible ray projected in a direction corresponding to an emission direction of the detection light.

2. The detecting device according to claim 1, wherein the detection light emitting portion is arranged so that, in the case where the knob portion is in the first state, the detection light is incident on a first region of the knob portion, and the visible light emitting portion is arranged so that, in the case where the knob portion is in the first state, the visible ray is incident on a second region of the knob portion.

3. The detecting device according to claim 2, wherein the second region is different from the first region, and the visible light emitting portion is arranged so as to emit visible light in a direction parallel to the emission direction of the detection light.

4. The detecting device according to claim 2, wherein the second region is coincident with the first region, and the visible light emitting portion is arranged so as to emit visible light in a tilted manner to the emission direction of the detection light.

5. The detecting device according to claim 1, wherein the visible light emitting portion is arranged in a direction orthogonal to the emission direction of the detection light with respect to the sensor portion.

6. The detecting device according to claim 1, further comprising an emitting position adjustment mechanism with which a distance between an installed surface to which the detecting device is attached and the detection light emitting portion is adjusted.

7. The detecting device according to claim 1, further comprising a battery that supplies power on which the sensor portion and the wireless communication portion operate or a battery mounting portion on which the battery is mounted.

8. An installing method of a detecting device that is arranged near a thumbturn and detects a state of the thumbturn, the thumbturn including a knob portion which is gripped and turned by a user to thereby switch between a first state and a second state, the method comprising:

providing a detecting device including, a sensor portion; and a wireless communication portion that transmits a signal corresponding to a detection result of the sensor portion by wireless communication, wherein the sensor portion includes a detection light emitting portion that emits detection light and a reflection light receiving portion that receives reflection light of the detection light reflected by the knob portion, the sensor portion detects whether the thumbturn is in the first state or in the second state, on the basis of whether or not the reflection light receiving portion has received the reflection light, the detection light is an infrared ray, and the detecting device further includes a visible light emitting portion that emits a visible ray in a direction according to an emission direction of the detection light; and adjusting an installation position of the detecting device on the basis of the visible ray such that the detection light emitting portion is arranged so that, in a case where the knob portion is in the first state, the reflection light is incident on the reflection light receiving portion and, in a case where the knob portion is in the second state, the reflection light is not incident on the reflection light receiving portion.

* * * * *